US005822934A

United States Patent [19]

O'Donnell

[11] Patent Number: 5,822,934

[45] Date of Patent: Oct. 20, 1998

[54] DRAIN

[76] Inventor: Richard O'Donnell, R.R. #1, Palgrave, Ontario, Canada, L0N 1P0

[21] Appl. No.: 839,734

[22] Filed: Apr. 15, 1997

[51] Int. Cl.[6] ..... E06B 7/14

[52] U.S. Cl. ..... 52/209; 52/214

[58] Field of Search ..... 52/209, 214, 208, 52/204.52

[56] References Cited

U.S. PATENT DOCUMENTS

| | | | |
|---|---|---|---|
| 1,919,367 | 7/1933 | Hamm et al. | 52/209 X |
| 3,314,201 | 4/1967 | Riegelman | 52/209 |
| 3,555,736 | 1/1971 | Koch, Jr. et al. | 52/209 X |
| 4,112,645 | 9/1978 | Greenfield | 52/209 |
| 4,512,125 | 4/1985 | Eriksson et al. | 52/209 |
| 4,691,487 | 9/1987 | Kessler | 52/209 |
| 5,044,121 | 9/1991 | Harbom et al. | 52/209 X |

*Primary Examiner*—Creighton Smith
*Assistant Examiner*—W. Glenn Edwards
*Attorney, Agent, or Firm*—Arne I. Fors

[57] ABSTRACT

A window or door drain at the base of an extruded window or door sash or frame. A rectangular frame having a peripheral front flange defines a front drain opening for abutment against a wall of the sash or frame in which a flap having a planar rear surface and a front surface is pivotally mounted for opening and closing the drain opening, the flap having upper and lower edges and side edges, and the flap upper edge being rounded with cylindrical lug extensions of the upper edge extending laterally of the flap side edges for insertion into round mating holes in side walls of the frame in proximity to the top wall of the frame. The flap pivots from a closed position on a diagonal rear wall upwardly to an open position adjacent the frame top wall in the front drain opening. The flap has a guide protrusion in each side edge for centering the flap during pivoting in the drain opening and the planar flap has a protrusion in the front surface adjacent the distal lower edge thereof for abutment against the frame top wall, whereby the flap is substantially unimpeded by surface tension when pivoted to an open position.

6 Claims, 4 Drawing Sheets

FIG.5.
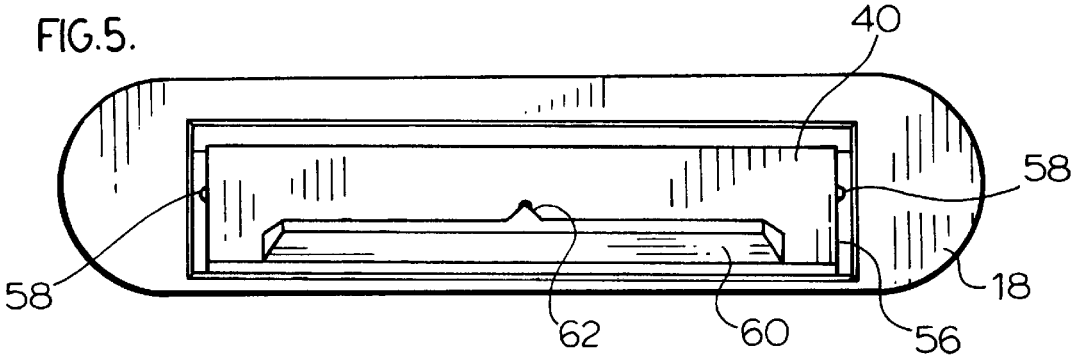
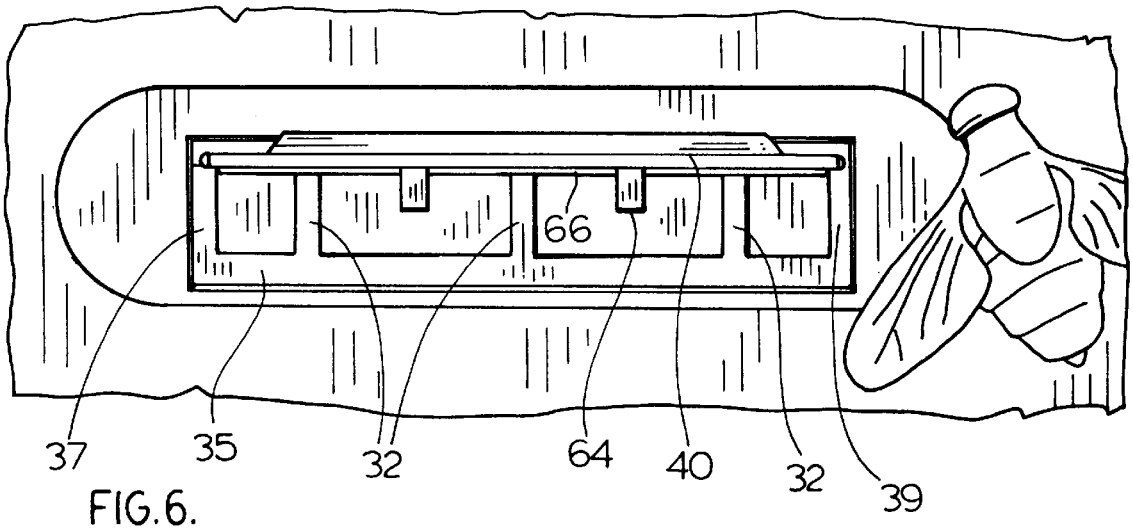
FIG.6.
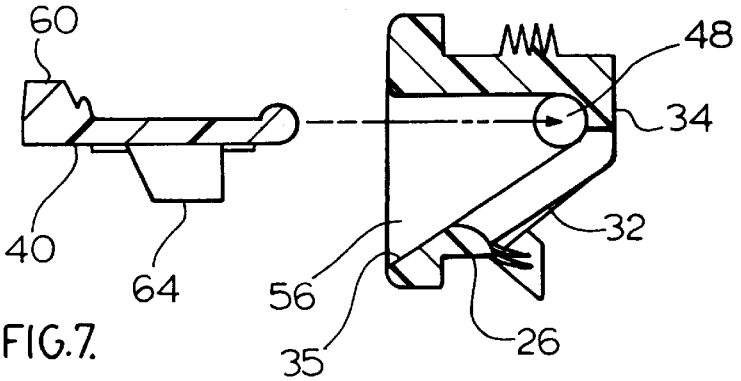
FIG.7.

DRAIN

BACKGROUND OF THE INVENTION (i). Field of the Invention

This invention relates to a window or door drain and, more particularly, relates to a water drain at the base of an extruded window or door sash or frame.

(ii). Description of the Related Art

Windows and doors having single or double pane construction typically comprise a sash perimeter surrounding the glass panes which is pivotally or slidably mounted within a frame. The interiors of the sash and frame, typically made from extruded plastics or metal alloys, are essentially hollow. Problems frequently arise from the collection of moisture within the sash and/or the frame and drain holes usually are provided to allow water to escape from the sash as it forms.

Closable drains for extruded plastic windows or sliding patio doors, for example, typically tend to jamb in a closed or an opened position, because of the miniature size of the drains, thereby trapping rainwater or condensate within the window or door sash if jambed shut or allowing air to blow through if jambed open. This can result in a substantial decrease in thermal efficiency and, particularly in cold northern climates and hot southern climates, can result in high heating or cooling costs with substantial discomfort to the inhabitants.

It is difficult to manufacture and to install small, air-tight drains without misalignment or malfunction of the component parts due largely to the small size and light weight of the miniature drain closure flap. Also, surface tension caused by a film of moisture can lock the drain flap in a open position, allowing air to blow through the open drain and permitting insects to enter the sash or frame.

It is a principal object of the present invention accordingly to provide a small, inexpensive and reliable drain assembly for extruded window or door sash or frame assemblies.

SUMMARY OF THE INVENTION

In its broad aspect, the water drain of the invention for insertion into a mating wall opening in an extruded, hollow door or window sash or frame comprises a rectangular frame having a peripheral front flange defining a front drain opening for abutment against a wall of the sash or frame, said frame having a deep top wall and a shallow bottom wall perpendicular to the front flange, an open diagonal rear wall defined by a plurality of spaced-apart ribs joining the distal ends of the top and bottom walls, and a pair of opposed side walls, means for securing the frame within the wall opening, and a flap having a planar rear surface and a front surface for opening and closing the drain opening, said flap having upper and lower edges and side edges, the flap upper edge being rounded with cylindrical lug extensions of the said upper edge extending laterally of the flap side edges for insertion into round mating holes in said side walls of the frame in proximity to the distal end of the frame top wall for pivotal mounting of the flap in the frame drain opening, whereby the flap can pivot from a closed position on the diagonal rear wall upwardly to an open position adjacent the frame top wall in the front drain opening. The flap has a guide protrusion in each side edge for centering the flap during pivoting in the drain opening and the planar flap has a protrusion in the front surface adjacent the distal lower edge thereof for abutment against the frame top wall, whereby the flap is substantially unimpeded by surface tension when pivoted to an open position. The planar flap preferably also has a peripheral upstanding rib on its rear surface adjacent its lower edge and side edges for abutment against the frame diagonal rear wall when closed, whereby the flap is substantially unimpeded by surface tension when closed. The means for securing the frame top wall in a sash or frame opening preferably comprises a plurality of upstanding elongated ribs parallel to the front flange formed on the frame top wall for frictionally engaging the said wall opening.

BRIEF DESCRIPTION OF THE DRAWINGS

The drain assembly of the invention will now be described in detail with reference to the accompanying drawings, in which:

FIG. 5 is front plan view of the drain in a closed position;

FIG. 6 is a front plan of the drain in an opened position;

FIG. 7 is an exploded vertical section of the drain with the flap separated from the housing;

DESCRIPTION OF THE PREFERRED EMBODIMENT

Figure 1:
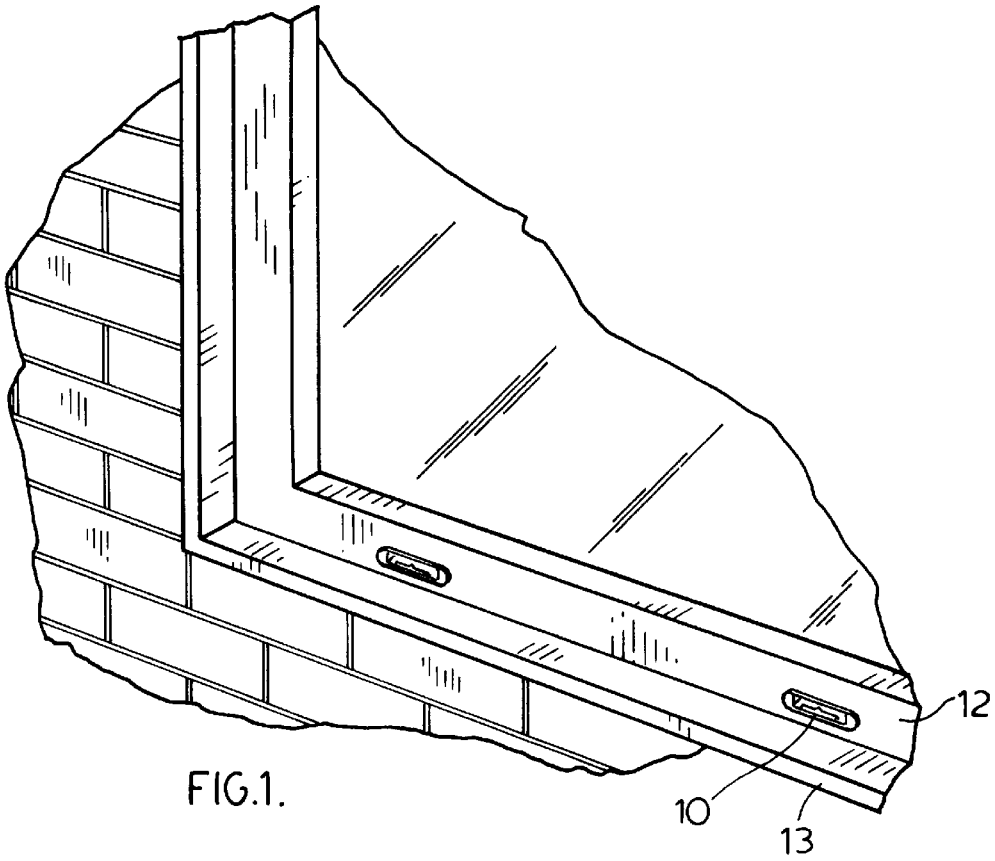
FIG. 1 is a perspective view, partly cut away, of a window or door sash having the drain of the present invention.

With reference to FIG. 1, the water drain 10 of the invention is shown installed in a window or patio door sash 12 slidably or pivotally mounted in a frame 13. It will be understood that although the description of the invention will proceed with reference to a window or door sash, the water drain of the invention can also be used in the hollow extruded frames for window and door sashes. Water collecting as a result of rain water leaking into the sash or condensate collecting within the sash drains by gravity to the base of the sash and is discharged through the drain.

Figure 2:
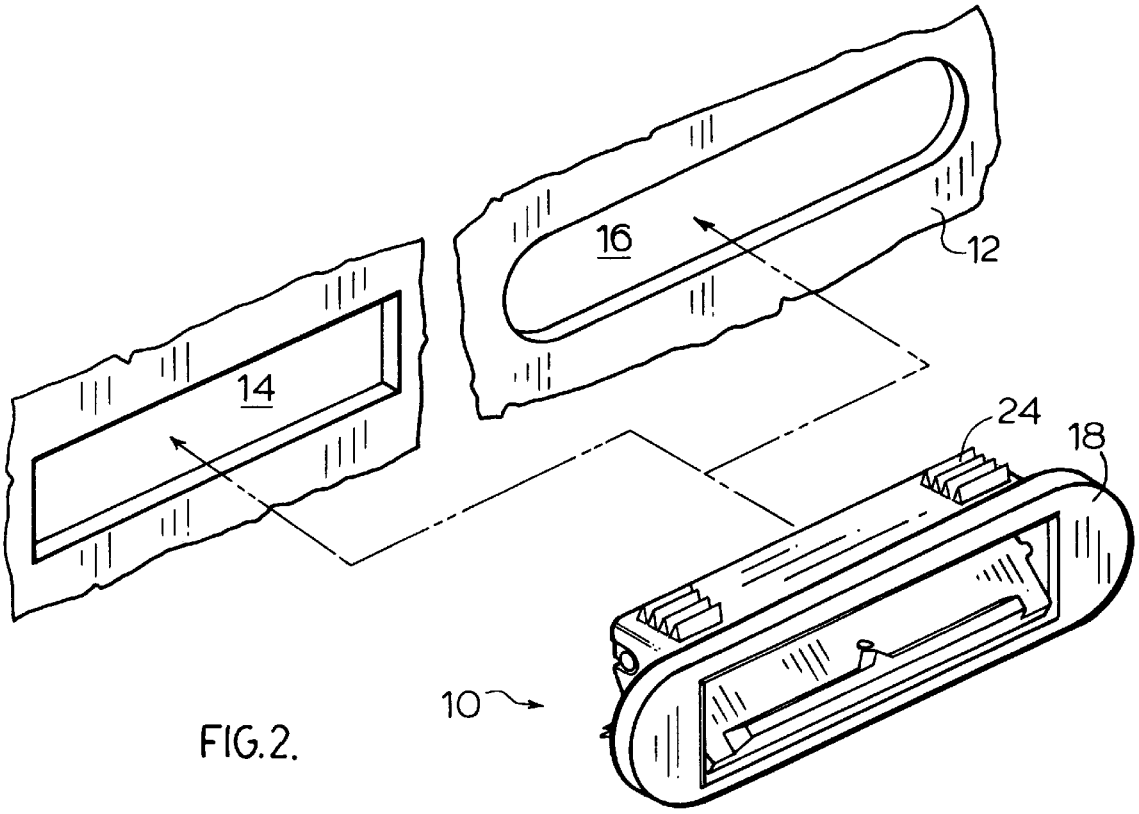
FIG. 2 is a fragmentary perspective view showing the drain of the invention preparatory to installation into a rectangular or elongated curved opening.
Figure 3:
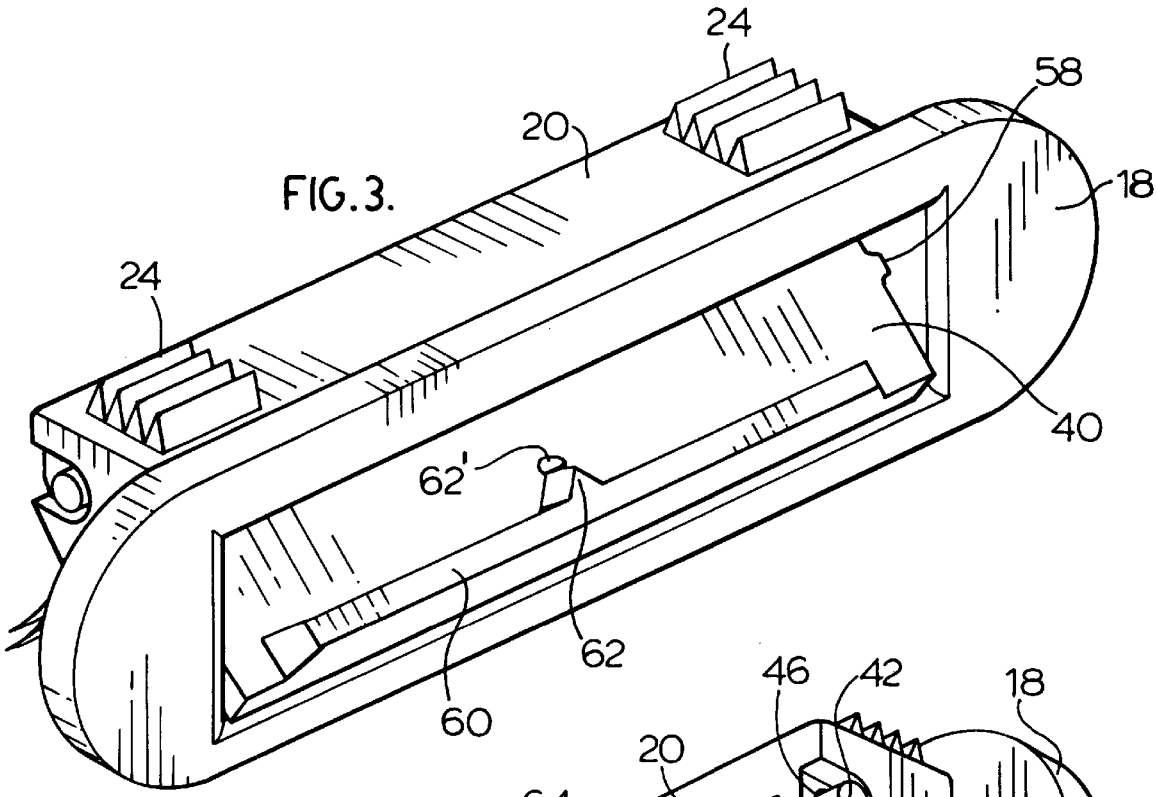
FIG. 3 is an enlarged upper front perspective view of the drain.
Figure 4:
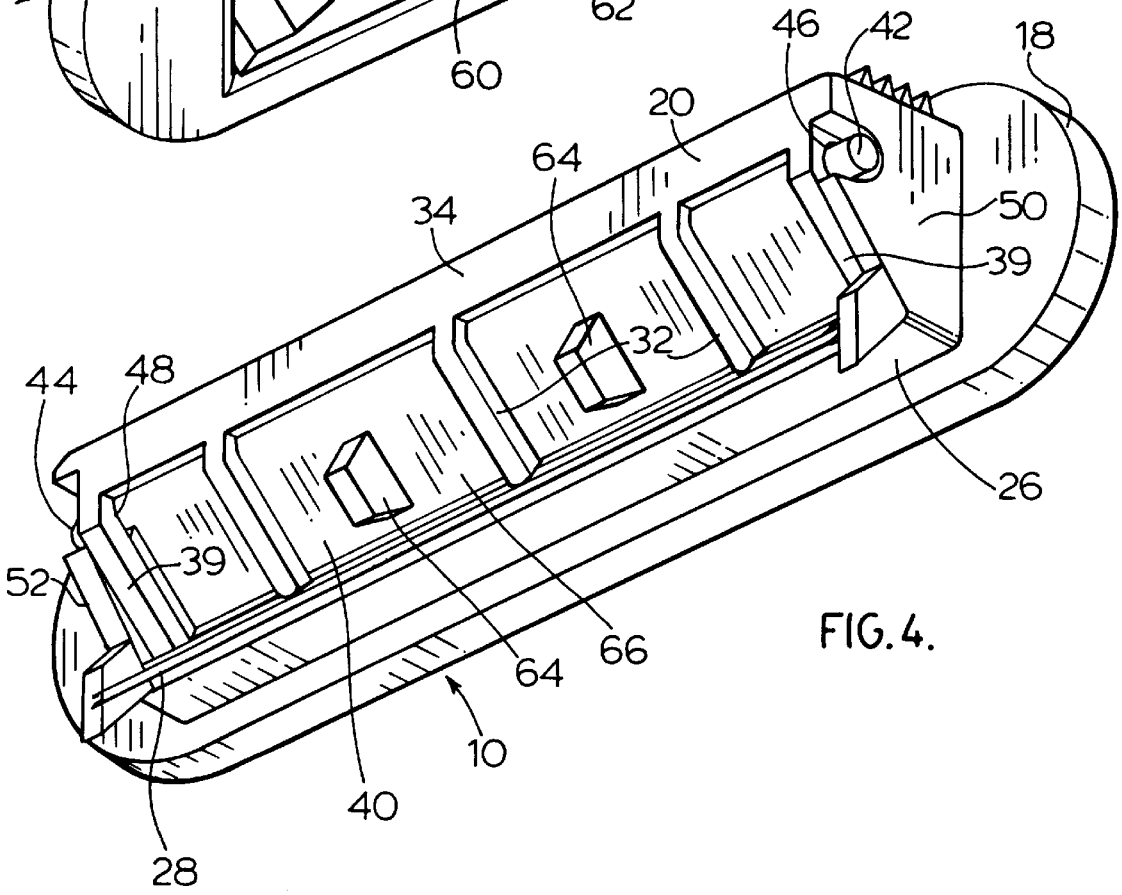
FIG. 4 is a lower rear perspective view of the drain.

FIG. 2 illustrates drain 10 installed either in a rectangular hole 14 or a rounded elongated hole 16, punched or routed in the thin wall of the sash 12. With reference to FIGS. 3, 4, 8, and 9, drain 10 has a front cover wall or flange 18 defining a front drain opening formed integral with a rear rectangular frame 20 by injection moulding of a plastics material such as nylon. The deep top wall 22 of frame 20 has a plurality of longitudinal, equispaced, upstanding V-shaped ribs 24 at each end and the bottom wall 26 preferably has a plurality of longitudinal pliable ribs 28 projecting rearwardly from convex rear edge 30. The rear distal side of frame 20 is bevelled rearwardly upwardly at about 45° from the bottom of wall 26 with a plurality of equispaced ribs 32 extending from rear edge 30 to merge with upper rear face 34 defining an open diagonal rear wall. The front edge 35 of lower wall 26 is bevelled coplanar with ribs 32 and, together with parallel ribs 37 and 39 formed at the sides of frame 20, provide a planar open seat for flap 40.

Figure 8:
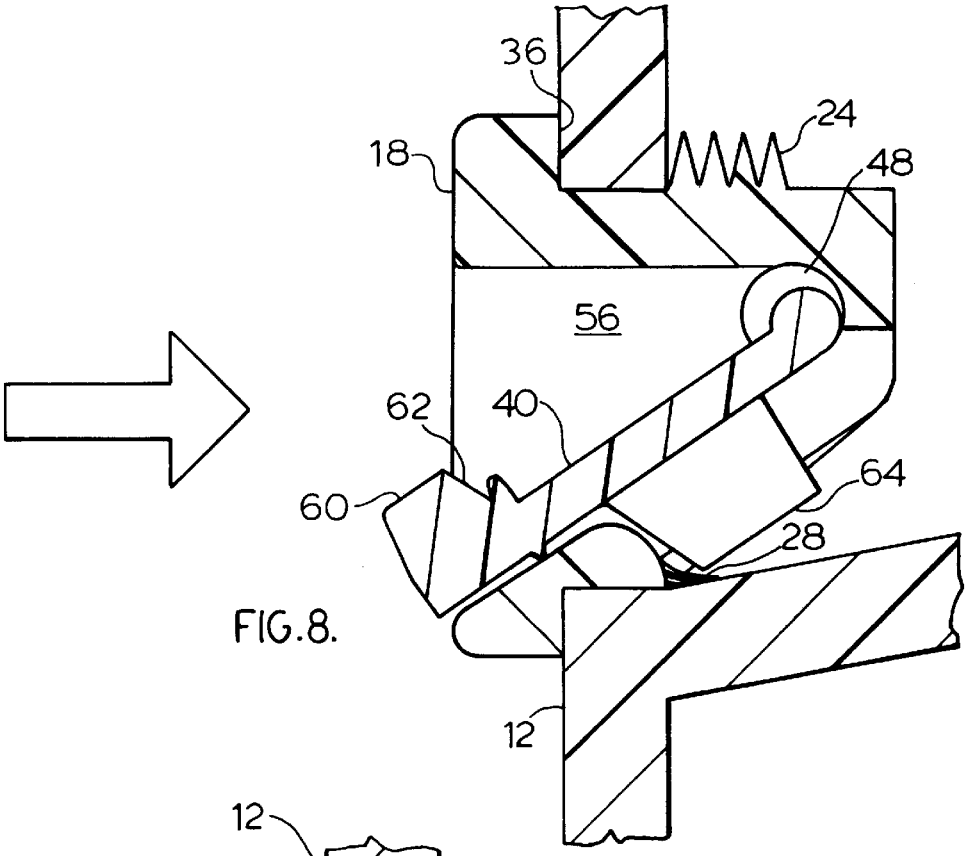
FIG. 8 is an enlarged vertical section of the drain with the flap in its closed position.
Figure 9:
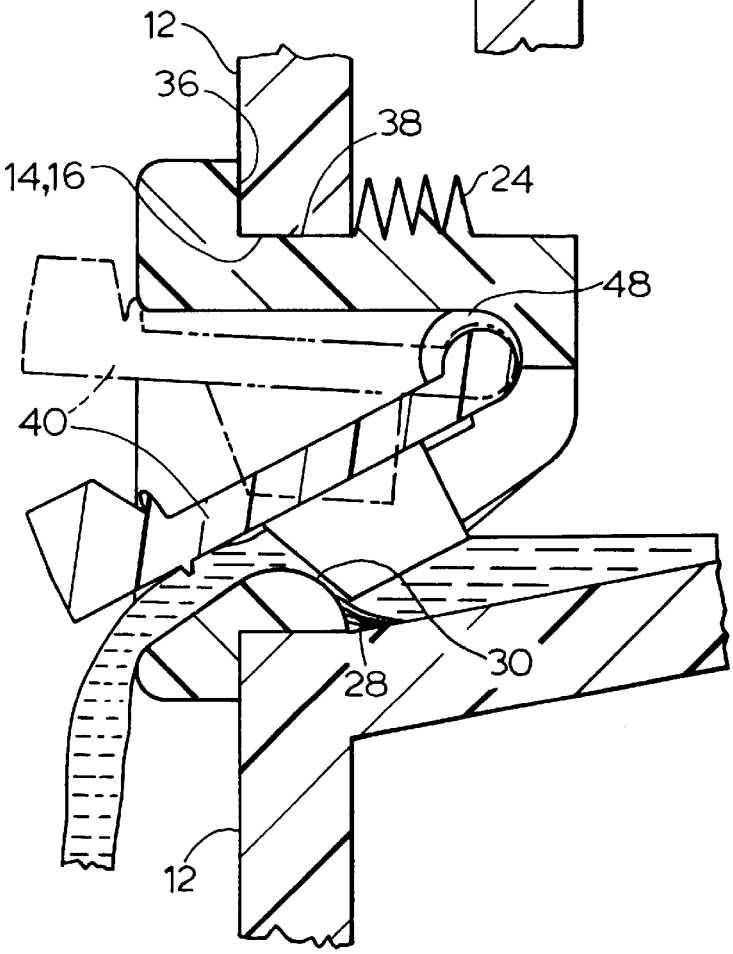
FIG. 9 is a vertical section corresponding to FIG. 8 in which the flap is shown in a partially open position and shown in a fully open position by ghost lines to allow the water to drain.

FIGS. 8 and 9 illustrate installation of drain 10 in openings 14 with the rear surface 36 of front cover wall 18 abutting sash 12. Upper ribs 24 ensure a frictional locking engagement with the sash opening, the upper edge 38 of opening 14 preferably fitting between surface 36 and the foremost of the ribs 24. Lower pliable ribs 28 biased against the lower edge of the sash opening provide a water deflector and seal while urging the frame 20 upwardly against the hole edge for secure engagement therewith.

Turning now to FIGS. 3–7, the rectangular flap 40, preferably also injected moulded from nylon, is pivotally mounted in frame 20 by cylindrical lug extensions 42, 44 projecting laterally from the rounded upper edge of flap 40 into round mating holes 46, 48 in the opposed side walls 50, 52 of frame 20.

With particular reference to FIGS. 5 and 6, flap 40 is slightly shorter in length than the length of rectangular opening 56 in frame 20 and is centered therein by small guide protrusions 58 at each side edge thereof to ensure free pivotal movement of flap 40.

A stiffening flange 60 at the bottom front face of flap 40 has a central protrusion 62 forming part thereof or adjacent thereto adapted to abut against the upper edge of opening 14 (FIG. 9) to limit the upward movement of flap 40 for reasons which will become apparent as the description proceeds. A pair of spaced apart protrusions 64 are formed on the rear face 66 of flap 40 to fit the openings between ribs 32 and a thin peripheral upstanding rib 67 preferably is formed along the sides and along lower edge of rear face 66 to seat on front edge 35 and side ribs 37 and 39.

In operation, the rectangular or rounded rectangular opening is formed in the front lower face of a window or door sash or frame. The drain 10, having the flap 40 snap-fitted into housing 20, is inserted into the opening to the position as shown most clearly in FIGS. 8 and 9. In the absence of water in the interior of the sash 12, the flap 40 assumes the closed, air-tight position shown in FIG. 8, peripheral rib 67 of flap 40 resting against side ribs 37 and 39 and bottom edge 35, shown in FIG. 4. When pivoted to an open position as depicted in FIGS. 6 and 9, to allow the escape of water, ribs 32 and protrusions 64 prevent the ingress of insects. Peripheral rib 67 prevents sticking of flap 40 to front edge 35 and ribs 37 and 39 due to surface tension. Upon completion of drainage of water, flap 40 pivots downwardly to its closed position, projection 62 preventing water surface tension from holding flap 40 in an open position against the upper edge of opening 56, as shown by ghost lines in FIG. 9.

The drain of the present invention provides a number of important advantages. The drain is small and easy to install while providing a positive and trouble free operation, both in its closed air-tight position and in its open water-drainage position. The drain flap does not stick in an open or closed position because of surface tension, notwithstanding its miniature size.

It will be understood, of course that modifications can be made in the embodiment of the invention illustrated and described herein without departing from the scope and purview of the invention as defined by the appended claims.

I claim:

1. A water drain for insertion into a mating wall opening in an extruded, hollow door or window sash or frame, comprising:

a rectangular frame having a peripheral front flange defining a front drain opening for abutment against a wall of the sash or frame, said frame having a top wall and a bottom wall perpendicular to the front flange, said top wall being relatively deep compared to the bottom wall, an open diagonal rear wall defined by a plurality of spaced-apart ribs joining the distal ends of the top and bottom walls, and a pair of opposed side walls joining the top and bottom walls, means for securing the frame within the wall opening, and a flap having a planar rear surface and a front surface for opening and closing the drain opening, said flap having upper and lower edges and side edges, the flap upper edge being rounded with cylindrical lug extensions of the said upper edge extending laterally of the flap side edges for insertion into round mating holes in said side walls of the frame in proximity to the distal end of the frame top wall for pivotal mounting of the flap in the frame drain opening, whereby the flap can pivot from a closed position on the diagonal rear wall adjacent the spaced-apart ribs upwardly to an open position adjacent the frame top wall in the front drain opening, and a protrusion in the front surface of the flap adjacent the lower edge thereof for abutment against the frame top wall, whereby the flap is substantially unimpeded by surface tension when pivoted to an open position.

2. A water drain as claimed in claim 1 in which the rectangular frame and the flap are formed of a rigid plastics material and in which the flap has a guide protrusion in each side edge for centering the flap during pivoting in the drain opening.

3. A water drain as claimed in claim 2 in which the means for securing the frame top wall in a sash or frame opening comprises a plurality of upstanding elongated ribs parallel to the front flange formed on the frame top wall for frictionally engaging the said wall opening.

4. A water drain as claimed in claim 2 in which the planar flap has a peripheral upstanding rib on its rear surface adjacent its lower edge and side edges for abutment against the frame diagonal rear wall when closed, whereby the flap is substantially unimpeded by surface tension when closed.

5. A water drain as claimed in claim 1 in which the open diagonal rear wall defines an angle of about 45° upwardly from the bottom wall.

6. A water drain as claimed in claim 1 in which the flap rear surface has a pair of spaced-apart protrusions formed thereon adapted to fit into the open diagonal rear wall between the spaced-apart ribs to prevent the ingress of insects when the flap is pivoted to the open position.

* * * * *